United States Patent [19]

Spademan

[11] 4,340,243

[45] Jul. 20, 1982

[54] RELEASABLE SKI BINDING WITH MECHANICAL TIME INTEGRATOR

[76] Inventor: Richard G. Spademan, Box 6410, Incline Village, Nev. 89450

[21] Appl. No.: 117,390

[22] Filed: Feb. 1, 1980

[51] Int. Cl.[3] ..... A63C 9/08

[52] U.S. Cl. ..... 280/624; 280/611

[58] Field of Search ..... 280/624, 618, 611, 634, 280/631, 613

[56] References Cited

U.S. PATENT DOCUMENTS

| | | | |
|---|---|---|---|
| 3,881,738 | 5/1975 | Salomon | 280/634 |
| 3,884,492 | 5/1975 | Spademan | 280/624 |
| 3,950,003 | 4/1976 | Korger | 280/618 |
| 4,000,567 | 1/1977 | Salomon | 280/613 |
| 4,182,524 | 1/1980 | Beyl | 280/618 |

FOREIGN PATENT DOCUMENTS

| | | | |
|---|---|---|---|
| 2816800 | 10/1979 | Fed. Rep. of Germany | 280/634 |

*Primary Examiner*—David M. Mitchell

[57] ABSTRACT

A releasable ski binding (1) is disclosed and described comprising separable binding parts (3) including clamping members (3c) for releasably securing a ski boot to a ski and responsive to a predetermined force applied to the binding parts (3) for a predetermined period of time for separating the binding parts (3). In the embodiment disclosed the members (52,53) are coupled in frictional engagement with one of the members (52) movable at a controllable rate of movement in response to a movement of the binding parts (3). With the predetermined force applied for the predetermined period of time, the movable member (52) effects a complete and substantially instantaneous release of all clamping forces from the binding parts (3).

14 Claims, 5 Drawing Figures

RELEASABLE SKI BINDING WITH MECHANICAL TIME INTEGRATOR

BACKGROUND OF THE INVENTION

The present invention relates to releasable ski bindings with movable binding parts including one or more movable clamping members in general and in particular to a releasable ski binding with a mechanical time integrator for controlling the releasing of the movable clamping members in the binding.

In a conventional ski binding a force unit comprising a spring member or the like is coupled to one or more movable clamping members for releasably securing a ski boot to a ski. During skiing maneuvers, particularly when the maneuvers involve skiing over rough and mogly terrain, and under fall conditions, which may involve longitudinal, lateral, twisting and heel-lifting movement, the movable clamping members are moved against the force of the force unit. Typically the force against which the clamping members are moved increases in proportion to the distance the clamping members are moved.

During certain skiing maneuvers, particularly over rough and mogly terrain, momentary shock loads can be applied to the binding parts which could, if not otherwise compensated for, effect a premature release of the boot from the binding. Even though the duration of the shock loads is insufficient to ordinarily cause injury to a skier's leg, such premature releasing of binding parts can, however, result in serious injury to a skier, particularly if it occurs at a high speed.

Forces which have a magnitude which is considered to be less than that ordinarily associated with the breaking of a skier's leg may nevertheless cause serious injury to the leg if applied to the binding parts over a relatively long period of time. These injuries may be in the form of sprains and fractures to the leg.

Consequently, a well designed ski binding should not release during momentary high level loading of the binding parts while at the same time it should be capable of releasing at much lower level loads which, due to the duration of their application, would otherwise result in serious leg injuries.

SUMMARY OF THE INVENTION

In view of the foregoing, a principal object of the present invention is a releasable ski binding in which there is provided a mechanical assembly which is responsive to a predetermined force applied for a predetermined length of time to the binding parts for effecting a complete release of the binding parts.

Another object of the present invention is a ski binding as described above in which there is provided a force unit for providing a clamping force, means for applying said clamping force to said binding parts and means for removing said clamping force from said binding parts when a predetermined force has been applied to said binding parts for a predetermined period of time.

Another object of the present invention is a ski binding as described above in which there is provided in a mechanical assembly, a pair of members movably mounted in frictional engagement for completely removing a clamping force from a clamping member in the binding when an external predetermined force has been applied to the binding for a predetermined period of time.

In all of the embodiments of the present invention described above means are also provided for controlling the magnitude of the force and the length of time the force is applied to the binding parts for effecting a complete release of the binding parts. With these controls the skier may readily adjust the clamping force and releasing conditions of the binding for various changes in slope and skiing conditions so as to avoid premature binding release while at the same time setting the bindings for a releasing thereof prior to serious leg injury.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Referring to FIGS. 1–4, there is provided a ski binding designated generally as 1. In the binding 1 there is provided a housing 2. Slidably mounted in the housing 2 there is provided a plurality of movable binding parts 3 including a connecting member **3*a***.

Figures 1, 2, 3:
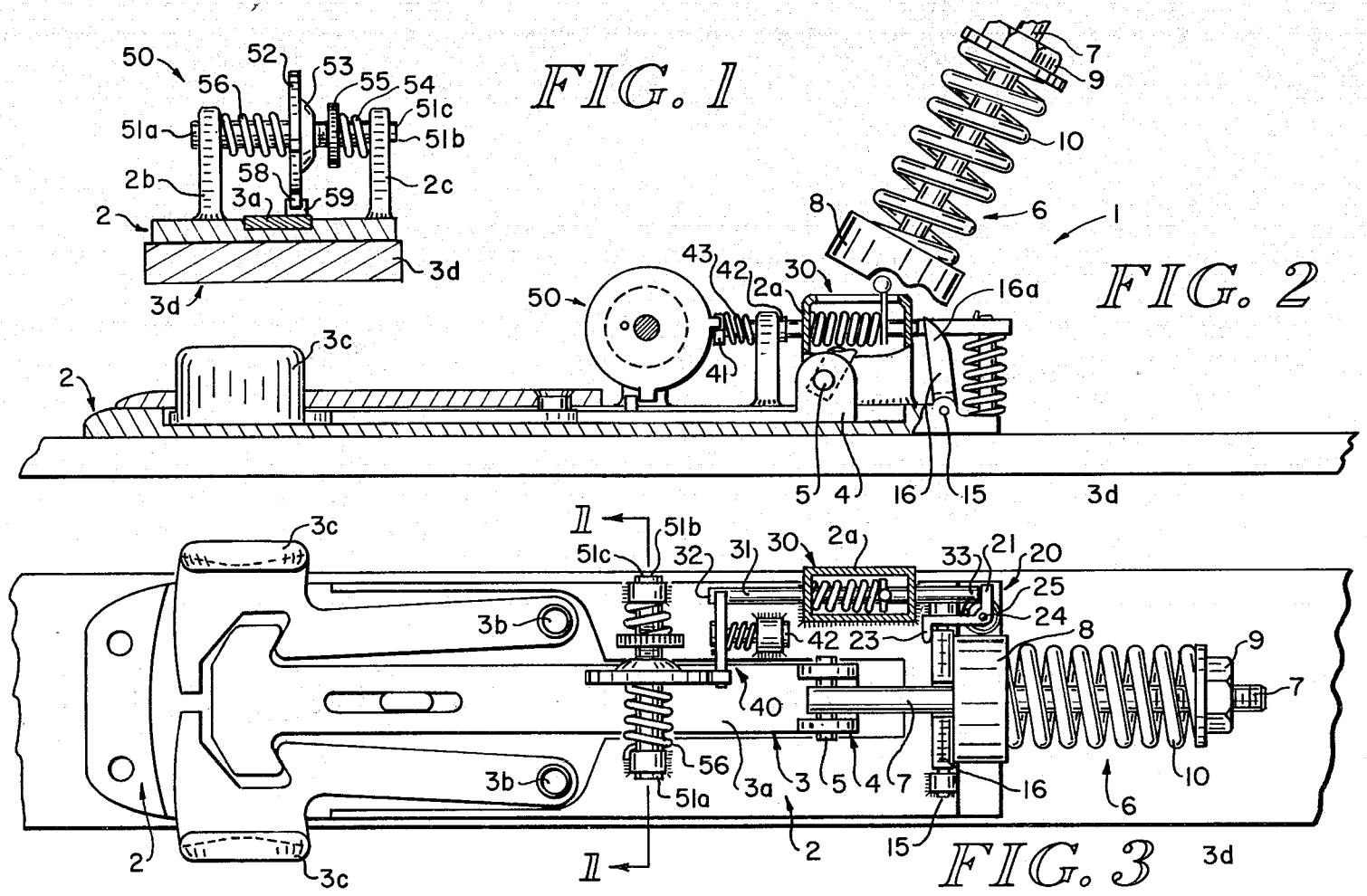
FIG. 1 is a partial end view of a ski binding according to the present invention with the spring adjustment assembly thereof omitted for clarity.
FIG. 2 is a partial side elevation view of FIG. 1.
FIG. 3 is a plan view of FIG. 2.
Figure 4:
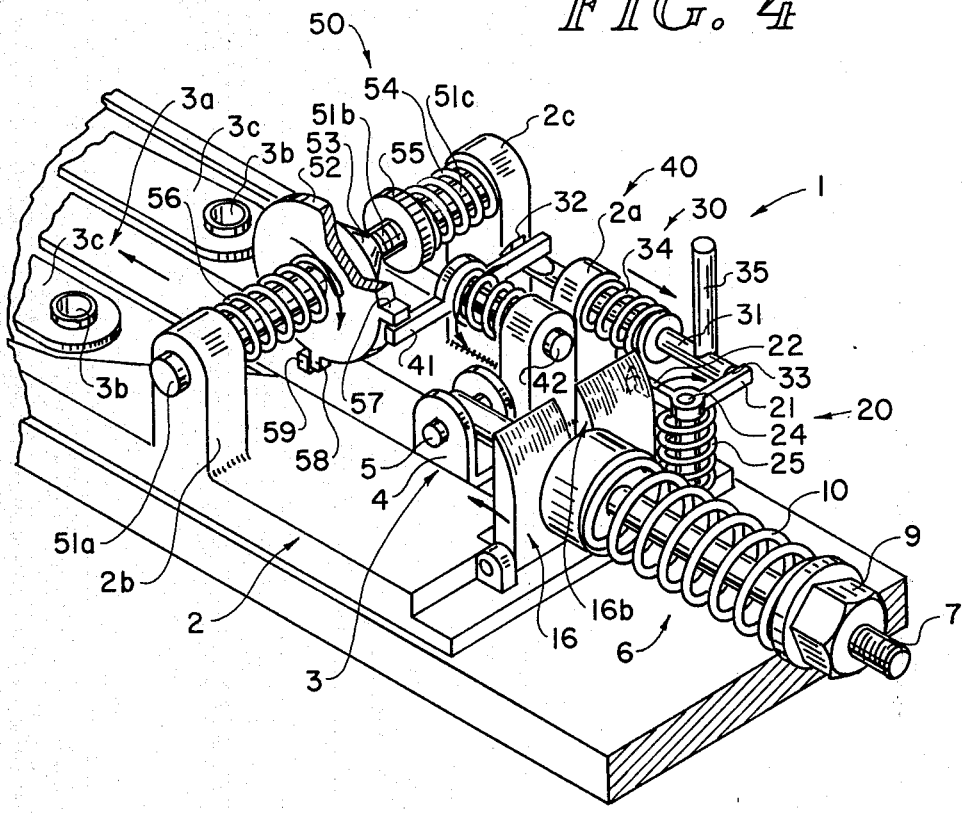
FIG. 4 is a perspective view of the principal component parts of the apparatus of FIGS. 1–3.

Coupled to the forward end of connecting member **3*a* for movement about a pivot pin 3*b*, as seen in FIG. 4, there is provided one or more clamping members 3*c*. The clamping members 3*c* are provided for releasably securing a ski boot to a ski 3*d***, such as, for example, the clamping members disclosed in applicant's U.S. Pat. No. 3,606,370.

At the rear end of connecting member **3*a* there is provided a pair of upstanding mounting arms 4. Pivotably coupled to the upstanding mounting arms 4, as by a pivot pin 5, there is provided a spring rod 7 of a spring adjustment assembly designated generally as 6**.

In the spring adjustment assembly 6 mounted on the forward end of the rod 7 there is provided a spring compression washer member 8. At the rear end of the rod 7 there is threadably fitted to the rod 7 an adjusting knob or nut 9. Concentrically mounted on the rod 7 between the washer 8 and the adjusting knob 9 there is provided a spring member 10. Spring member 10, as will be described in further detail below, is provided for providing a clamping force for the clamping members **3*c***.

Movably mounted to the housing 2 by means of a pivot pin 15 there is provided a spring plate 16 having a beveled upper edge **16*a*. The beveled upper edge 16*a* of the spring plate 16 is provided for slidably receiving the forward surface of the washer 8 for compressing the spring 10 when the spring plate 16 is latched in a position for compressing the spring 10**.

Mounted for latching the spring plate 16 in its spring-compressing position there is provided a movable trigger assembly designated generally as 20. In the trigger assembly 20 there is provided a trigger-actuating arm 21 and a trigger latching arm 22. The trigger latching arm 22 is provided with a latching head 23 for releasably engaging and latching the spring plate 16 into a position wherein it compresses the spring member 10.

For pivotable movement relative to the spring plate 16, the trigger assembly 20 is pivotably mounted to the housing 2 by means of a trigger pivot post 24. As will be described, assembly 20 provides a means for completely removing the clamping force from the binding parts. Mounted on the pivot post 24 there is provided a trigger spring 25. The trigger spring 25 is provided for returning the trigger assembly 20 to its latching position during resetting of the binding, as will be described in more detail below.

Mounted in a portion of the housing 2 (represented by a small section 2*a* of the housing in FIG. 3) there is provided a connecting pin compression assembly designated generally as 30. In the assembly 30 there is provided a compression pin member 31. At its forward end the pin member 31 is provided with a head 32. At its rear end, designated as 33, the pin member 31 contacts the trigger arm 21 for moving the trigger assembly 20. Coupled about the pin member 31 there is provided a spring member 34. The spring member 34 is connected to the housing 2 for moving the pin member 31 against the trigger arm 21 when the pin member 31 is released. Extending from the pin member 31 there is also provided a cocking lever 35. The lever 35 is provided for cocking and resetting the assembly 30 after its release, as will be described below.

At the forward end of the connecting pin compression spring assembly 30 there is provided a linkage lever assembly designated generally as 40. In the assembly 40 there is provided a linkage member 41. The linkage member 41 is pivotably mounted to the housing 2 by means of a pivot pin 42 with one end thereof positioned to engage the head 32 of the connecting pin compression spring assembly 30. For resetting the member 41, a spring member 43 is coupled to the linkage member 41 for moving the linkage member 41 into engagement with the head 32.

At its opposite end the linkage lever assembly 40 is coupled to a friction wheel assembly designated generally as 50. In the wheel assembly 50 there is provided a shaft 51*a* and a shaft 51*b*. Shafts 51*a* and 51*b* are supported in a cantilever fashion by a pair of supporting housing members 2*b* and 2*c*, respectively. Mounted for rotation on the shaft 51*a* there is provided a first wheel member 52. Mounted on the shaft 51*b*, with its movement restricted to transverse movement relative to the wheel 52, there is provided a second wheel member 53. Wheel members 52 and 53, with wheel member 53 serving as a braking member, define releasing members and are held in frictional engagement by means of a spring member 54 concentrically mounted on the shaft 51*b*.

Threadably coupled to the shaft 51*b* and abutting the spring member 54 there is provided an adjusting nut 55. Extending outwardly from the nut 55, the shaft 51*b* is provided with a flattened surface 51*c*. The flattened surface 51*c* is provided for preventing the rotation of the shaft 51*b* and the wheel 53 relative to the supporting housing member 2*c* while permitting the shaft 51*b* and the wheel 53 to be moved transversely relative to the wheel 52. The adjusting nut 55 is provided for adjusting the compression of the spring member 54 while the transverse movement of the shaft 51*b* and wheel 53 control the degree of frictional engagement between the wheels 52 and 53.

Coupled to the wheel 52 there is provided a spring member 56. The spring member 56 is coupled to the wheel 52 for moving the wheel 52 when the connecting member 3*a* is moved, as will be described.

Extending from the periphery of the wheel 52 there is provided a pair of engaging members 57 and 58. The engaging member 57 is provided for engaging one end of the linkage member 41 opposite the end of the linkage member 41 which engages the head 32 of the connecting pin compression spring assembly 30. The second engaging member 58 is provided for engaging a corresponding engaging member 59 extending from the connecting member 3*a*.

Referring to FIG. 4, the binding 1 is shown in its condition immediately preceding an involuntary release. In its condition immediately preceding an involuntary release, the spring plate member 16 is latched by means of the trigger assembly 20 in a substantially vertical position. In its latched position the spring plate 16 compresses the clamping member spring 10 drawing the connecting member 3*a* rearwardly and the clamping members 3*c* to their closed or clamping position. With the spring plate member 16 in its latched position, the pin member 31 is also in a forward position, the spring 34 of the connecting pin compression spring assembly 30 is compressed and the head 32 of the pin member 31 is latched by the lever assembly 40. With the lever assembly 40 latched in its pre-release position, the member 57 of the friction wheel 52 is counter-clockwise of the lever member 41, the member 59 is abutting the member 58 holding the wheel 52 against the force of the spring 56, the spring 43 on the lever member 41 is in a relaxed condition and the spring 56 on the wheel 52 is under tension.

As the clamping members 3*c* are forced open during an involuntary release, the connecting member 3*a* is pulled forwardly in the direction of the arrow against the force of the spring 10 bearing against the spring plate 16. As the connecting member 3*a* is pulled forwardly by the opening of the clamping members 3*c*, the engaging member 59 on the connecting member 3*a* is separated from the engaging member 58 extending from the friction wheel 52. As the engaging member 59 is separated from the engaging member 58, the wheel 52 is freed to rotate in a clockwise direction in response to a relaxation of the spring member 56. The rate of rotation of the wheel 52 is determined by the frictional engagement between the wheel 52 and the wheel 53 and the force applied to the wheel 52 and 53 by the spring 54. This force is adjustable by the adjusting nut 55.

As the wheel 52 rotates in a clockwise direction, the member 57 comes into contact with one end of the lever member 41. As the member 57 comes into contact with the member 41, the member 41 is forced downwardly in the direction of the arrow, pivoting the member 41 about the axis of the pin 42, increasing the tension on the spring 43 and releasing the pin member 31 of the connecting pin compression spring assembly 30.

As the pin member 31 is released, the spring 34 forces the pin member 31 rearwardly in the direction of the arrow against the arm 21 of the trigger assembly 20, pivoting the trigger assembly 20 about the trigger post 24. As the trigger assembly 20 is pivoted about the trigger post 24, the trigger latch 22 and head 23 release the spring plate 16. As the spring plate 16 is released, it pivots forwardly about the axis of the pin 15 in response to the force of the spring 10. As the spring plate 16 pivots forwardly, the rod 7 of the spring adjustment assembly 6 is freed to exit a slot 16*b* provided therefor in the spring plate 16. As the rod 7 exits the slot 16*b*, the spring 10 becomes relaxed, removing the clamping forces from the clamping members 3c. The removal of all clamping forces from the clamping members 3c provides, for all practical purposes, a complete and instantaneous release of the clamping members 3c.

To reset the binding, the connecting pin compression assembly 30 is reset first by forward pressure brought to bear on the cocking lever pin 35 which moves the pin member 31 forwardly for engaging the head 32 and the lever member 41. After the pin member 31 is engaged by the lever member 41, the trigger assembly 20 is positioned by the trigger spring 25 to its initial pre-release condition. With the trigger assembly 20 in its pre-release condition, the spring plate 16 is pivoted upwardly and latched by the head 23 of trigger latching arm 22. As the spring plate 16 is latched by the trigger latching arm 22, the spring adjustment assembly 6 is pivoted downwardly about the axis of the pin until the forward surface of the washer 8 comes into contact with the upper beveled surface 16a of the spring plate 16. As the washer 8 contacts the surface 16a of the spring plate 16, downward pressure on the spring-adjustment assembly 6 forces the rod 7 into the slot 16b compressing the spring 10. As the spring 10 is compressed, the connecting member 3a is forced rearwardly causing the engaging member 59 to engage the member 58 on the wheel 52. As the member 59 engages the member 58 on the wheel 52, the wheel 52 is rotated counter-clockwise against the force of the spring 56. As the wheel 52 is rotated counter-clockwise against the force of the spring 56, the clamping members are drawn into their closed position.

Figure 5:
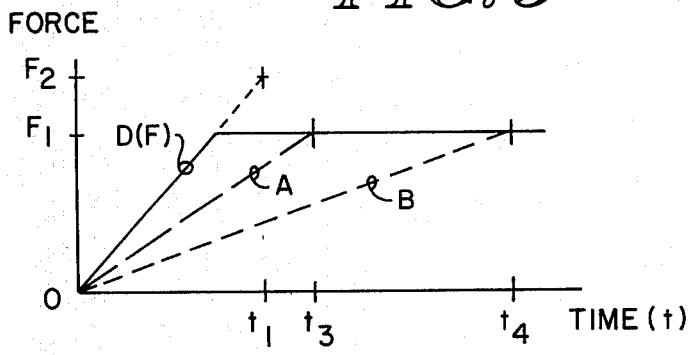
FIG. 5 is a graphic representation of applied force and alternative releasing conditions for a binding made according to the present invention.

Referring to FIG. 5, there is shown three curves designated D(F), A and B with respect to time (t). The curve D(F) represents forces applied to the binding parts during an involuntary release. Curve A represents one setting of a binding according to the present invention and curve B represents an alternative setting of a binding according to the present invention.

If the forces applied to the binding parts during an involuntary release equal a level of force designated as $F_2$, the spring 10 will have been compressed and the connecting member 3a will have been displaced forwardly by an amount sufficient to effect a release of a ski boot from the binding in a conventional manner, such as disclosed and described in applicant's U.S. Pat. No. 3,606,370. If the force applied to the ski binding parts is less than the force $F_2$, but greater than a force $F_1$, required to separate the member 59 on the connecting member 3a from the member 58 on the friction wheel 52, then a release will occur only after a predetermined period of time, $t_3$, $t_4$ . . . , determined by the rate of rotation of the wheel 52 relative to the wheel 53. This rate of rotation is determined and controlled by the spring 54 and the frictional interface between the wheels 52 and 53. If the frictional forces between the wheels 52 and 53 are relatively low, then the time it will take for the wheel 52 to rotate clockwise relative to the wheel 53 will be relatively short, as shown by the curve A in FIG. 5. If the spring 54 is adjusted for increasing the frictional forces between the wheels 52 and 53, the rate of rotation of the wheel 52 relative to the wheel 53 will be decreased, increasing the amount of time it takes for the wheel 52 to rotate relative to the wheel 53 for releasing the binding, as shown by the curve B of FIG. 5.

From the curves D(F), A and B, it will be seen that a skier can determine and control and indeed set a ski binding to withstand a variety of relatively high momentary forces without undergoing a premature release while, with the same settings, obtain a release with much lower forces applied over a somewhat longer period of time.

While an embodiment of the present invention is disclosed and described, it is contemplated that various modifications may be made thereto without departing from the spirit and scope of the present invention. For example, it is contemplated that a variety of other friction-type devices and other apparatus which moves as a function of time at predetermined rates may be employed instead of the friction wheels 52 and 53 in the wheel assembly 50. Also, a variety of different lever and latching assemblies may also be employed without departing from the spirit and scope of the present invention. Accordingly, it is intended that the embodiment disclosed and described be employed only for purposes of illustrating the present invention and that the scope of the present invention be determined solely by reference to the claims hereinafter provided and their equivalents.

What is claimed is:

1. A releasable ski binding comprising: separable binding parts for releasably securing a ski boot to a ski at a location on the ski boot rearwardly of the toe and forwardly of the rear of the heel; mechanical means including a pair of relatively shiftable first and second releasing members; first means biasing the second member into frictional engagement with the first member; second means coupled with the first member for biasing the same for movement relative to the second member responsive to a predetermined force applied to said binding parts for a predetermined period of time, said first member being operable for separating said binding parts when said first member moves relative to the second member under the influence of said second means; and means coupled with the second member for adjusting the bias force of said first means.

2. A releasable ski binding according to claim 1 wherein the magnitude of said predetermined force is inversely proportional to the magnitude of said predetermined period of time.

3. A releasable ski binding according to claim 1 wherein said binding parts comprise means which move in response to the application of a force applied thereto; a force unit for applying a clamping force to said binding parts; and said first member comprises means responsive to a predetermined movement of said binding parts for completely removing said clamping force from said binding parts.

4. A releasable ski binding according to claim 1 wherein said binding parts comprise movable binding parts which move in response to the application of a force applied thereto; a force unit for applying a clamping force to said binding parts; and said second means being responsive to a movement of said binding parts caused by said predetermined force; and means responsive to a predetermined movement of said first releasing member relative to said second releasing member for completely removing said clamping force from said binding parts.

5. A releasable ski binding according to claim 4 wherein said binding parts comprise an engaging member which moves relative to said first releasing member when said binding parts are moved and said first releasing member comprises means engaged by said engaging member of said binding parts for restricting said moving of said first releasing member until said engaging member of said binding parts has undergone a predetermined movement relative to said first releasing member.

6. A releasable binding according to claim 4 wherein said second means comprises a spring member.

7. A releasable ski binding according to claim 4 wherein said second means comprises means for controlling the rate of movement of said first releasing means relative to said second releasing means.

8. A releasable ski binding according to claim 4 wherein said force unit comprises a spring member and a movable means for compressing said spring member and said clamping force-removing means comprises means for removing said compressing means from said spring member.

9. A releasable ski binding according to claim 8 wherein said compressing means removing means comprises:

a movable latching means for latching said compressing means; and means for unlatching said latching means from said compressing means.

10. A releasable ski binding comprising: separable, movable binding parts for releasably securing a ski boot to a ski, said binding parts being moved in response to the application of a force applied thereto; a force unit for applying a clamping force to the binding parts; and mechanical means responsive to a predetermined force applied to said binding parts for a predetermined period of time for separating said binding parts, said separating means including a first and a second releasing member; means for moving said first releasing member relative to said second releasing member in response to a movement of said binding parts, said moving means including means for controlling the rate of movement of said first releasing member relative to said second releasing member, said first and second releasing members being held together in frictional engagement, and said rate controlling means comprising means for controlling the magnitude of the friction with which said first and second releasing members are engaged; and means responsive to a predetermined movement of said first releasing member relative to said second releasing member for completely removing said clamping force from said binding parts.

11. A releasable ski binding according to claim 10, wherein said means for controlling the magnitude of the friction with which said first and said second releasing members are engaged comprises a spring means.

12. A releasable ski binding comprising: separable, movable binding parts for releasably securing a ski boot to a ski, said binding parts being moved in response to the application of a force applied thereto; a force unit for applying a clamping force to the binding parts; and mechanical means responsive to a predetermined force applied to said binding parts for a predetermined period of time for separating said binding parts, said separating means including a first and a second releasing member; means for moving said first releasing member relative to said second releasing member in response to a movement of said binding parts, said moving means including means for controlling the rate of movement of said first releasing member relative to said second releasing member, said rate-controlling means comprising means for adjusting the rate of movement of said first releasing member relative to said second releasing member; and means responsive to a predetermined movement of said first releasing member relative to said second releasing member for completely removing said clamping force from said binding parts.

13. A releasable ski binding according to claim 12, wherein said rate-controlling means comprises a spring member for providing a spring force and said rate-adjusting means comprises means for adjusting said force of said spring member.

14. A releasable ski binding comprising: separable binding parts for releasably securing a ski boot to a ski at a location on the ski boot rearwardly of the toe and forwardly of the rear of the heel; mechanical means including a pair of relatively shiftable first and second releasing members; first means biasing the second member into frictional engagement with the first member; second means coupled with the first member for biasing the same for movement relative to the second member responsive to a predetermined displacement of said binding parts for a predetermined period of time, said first member being operable for separating said binding parts when said first member moves relative to the second member under the influence of said second means; and means coupled with the second member for adjusting the bias force of said first means.

* * * * *